US005445586A

United States Patent [19]

Yun

[11] Patent Number: 5,445,586

[45] Date of Patent: Aug. 29, 1995

[54] STRUCTURE OF JUMP ROPE

[76] Inventor: Chen L. Yun, Suite 1, 11F. No. 95-8 Chang Ping Rd. Sec. 1, Taichung, Taiwan

[21] Appl. No.: 304,925

[22] Filed: Sep. 13, 1994

[51] Int. Cl.[6] ..... A63B 5/20

[52] U.S. Cl. ..... 482/82

[58] Field of Search ..... 482/81, 82, 148; 434/255

[56] References Cited

U.S. PATENT DOCUMENTS 4,293,125 10/1981 Hinds ..... 482/82

FOREIGN PATENT DOCUMENTS 0000667 of 1889 United Kingdom ..... 482/82

2164574 3/1986 United Kingdom ..... 482/82

*Primary Examiner*—Stephen R. Crow

[57] ABSTRACT

A jump rope comprises a cord assembly and a pair of handle assemblies for flexibly coupling the cord assembly. Each handle assembly has a hollow cylinder handle having a large diameter flange integral with an annular member formed at one end, a cap member having a centrally formed circular hole fastened to the annular member and a funnel shaped adaptor intermediately retained within a circular space between the cap member and the annular member. A hoop member connected to each end of the cord is flexibly retained by the funnel shaped adaptor of the handle assembly therein so as to prevent the cord from twisting or jamming.

1 Claim, 3 Drawing Sheets

STRUCTURE OF JUMP ROPE

BACKGROUND OF THE INVENTION

The present invention relates to jump ropes, more particularly to a handle assembly for jump rope which provides a removably device for flexibly coupling of the cord of jump rope and which is of a simplified type that is ready to connect and inexpensive to manufacture.

Prior art jump ropes typically adapt a hemispherical socket fastened to one end of a cylinder handle and a ball with a tubular coupler extended therefrom for connecting the end of the cord. The ball is movably retained within the hemispherical socket, so that the connection is pivatal between the handle and the cord in order to prevent the cord from to be twisted or jammed during operation. Another jump rope type shows a hemispherical socket with a tubular coupler extending therefrom connected to the end of the cord and a ball with a smaller diameter ball fastened to one end of the handle. The ball is movably retained within the socket so as to provide a similar pivotal connection therebetween. A simple jump rope type provided is one having a large diameter hollow ball screw fastened to a spherical surface on the end of the handle. A circular recess formed on opposing spherical surface is accessible to the end of the cord to which a smaller diameter ball is secured and movably retained by the hollow ball therein. However, they have the common disadvantages of complicated structure that is inconvenient and expensive to manufacture.

SUMMARY OF THE PRESENT INVENTION

The main object of the present invention is to provide a structure of jump rope which has a simplified juncture allowing a flexible connection between the cord and the handle so as to prevent the cord of the jump rope from twisting or jamming.

Another object of the present invention is to provide a jump rope which is ease of use and inexpensive to manufacture.

Accordingly, the structure of jump rope of the present invention comprises a pair of handle assemblies, each has a hallow cylinder handle having a large diameter flange formed at one end integral with a large diameter annular member extending outward therefrom. The annular member includes a circular wall with threaded outer periphery and defines a stepped circular open space therein, a cap member having a threaded inner periphery in registry with the threaded outer periphery of the annular member and a circular hole centrally formed on the back portion, a funnel shaped adaptor having a hollow hemispherical portion integral with the funnel and having a tubular portion, and a cord connected at each end to a hoop member which is movably retained by the hollow hemispherical portion of the funnel shaped adaptor and secured into the stepped circular space of the handle by the cap member.

The present invention will be more fully understood by reference to the following detailed description thereof when read with the drawings.

DETAILED DESCRIPTION OF THE PREFERRED EMBODIMENT OF THE PRESENT INVENTION

Figure 1:
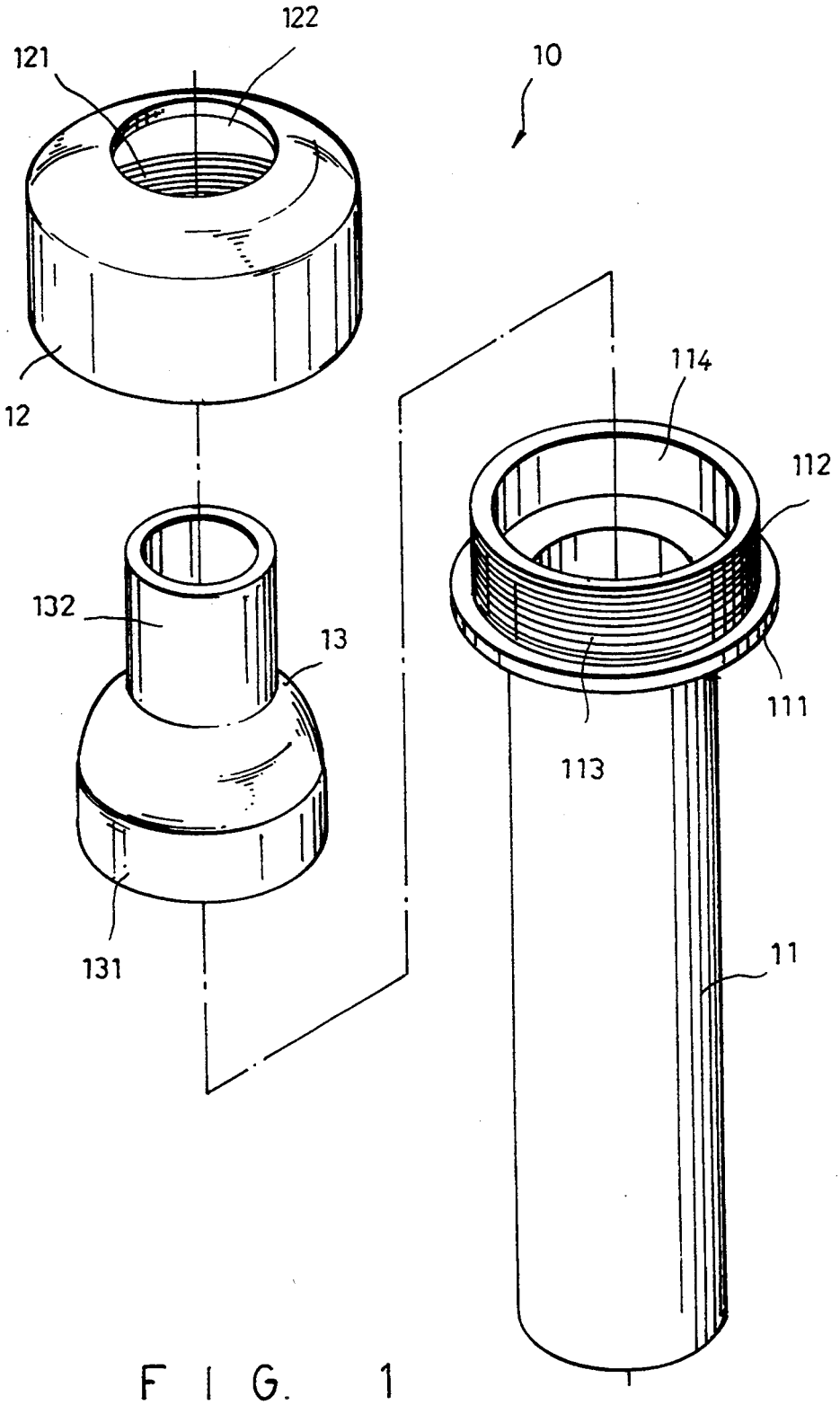
FIG. 1 is an exploded perspective view to show a handle assembly of the present invention.
Figure 2:
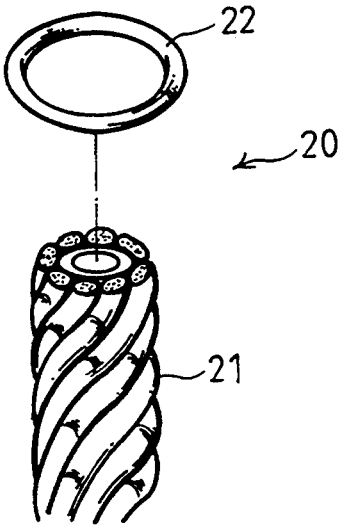
FIG. 2 is a perspective view to show a cord connected with a hoop member according to the present invention.

With reference to FIGS. 1 and 2 of the drawings, the jump rope of the present invention comprises a pair of handle assemblies 10 and a cord assembly 20 flexibly connected with the handle assemblies 10 therebetween.

Each of the handle assemblies 10 is comprised of a hollow cylinder handle 11 having a large diameter flange 111 formed at one end integral with a large diameter annular member 112 extending outward therfrom. The annular member 112 includes a circular wall with threaded outer periphery 113 defining a stepped circular open space 114 therein, a cap member 12 having a threaded inner periphery 121 formed in registry with the threaded outer periphery of the annular member 112 and a circular hole 122 centrally formed on the back portion thereof, a funnel shaped adaptor 13 having a hollow hemispherical portion 131 and a tubular portion 132 centrally extended from the bottom of the hemispherical portion 131 and communicated with each other. The outer diameter of the hemispherical portion 131 of the funnel adaptor 13 is slightly less than the inner diameter of the annular member 112 and the outer diameter of the tubular portion thereof is slightly less than the diameter of the circular hold 122 of the cap member 12. The tubular portion 132 of the funnel shaped adaptor 13 can be protruded outward through the circular hole 122 when the cap member fastens to the annular member 112 of the handle 11 and the hemispherical portion 131 of the funnel adaptor is intermediately retained by the cap member 12 into the circular space 114 of the handle 11.

The cord assembly 20 comprises a cord 21 connected at each end with a hoop member 22.

Figure 3:
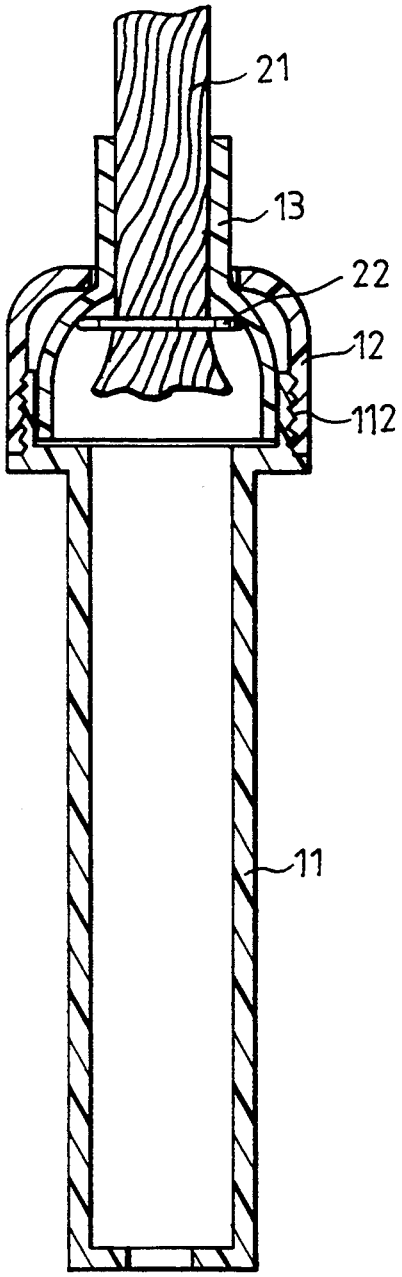
FIG. 3 is a sectional view of the preferred embodiment of the present invention illustrating the hoop member of the cord being movably retained by the funnel shaped adapter of the handle assembly.

Referring to FIG. 3, the coupling of the cord assembly to the two handle assemblies has been accomplished in the same manner to telescope a funnel shaped adaptor 13 into the circular hole 122 of a cap member 12 and inserting one end of the cord 21 into the adapter 13 via the tubular portion 132 thereof and wrapping a hoop member 22 onto the end of the cord 21 until it protrudes from the other end of the adaptor 13 and flatten the hoop member 22 to be fixedly attached to the cord, then fastening the cap member 12 together with adaptor 13 and the cord assembly 20 into the annular member 112 of the hollow cylinder handle 11. The hoop members 22 on both ends of the cord 21 are flexibly retained by the funnel shaped adaptor 13 inside the circular space 114 of the handle 11.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A jump rope comprising a cord assembly flexibly joined with a pair of handle assemblies wherein:

each said handle assembly comprising:

a hollow cylinder handle having a large diameter flange formed at one end and integral with a large diameter annular member extending outward therefrom, said annular member having a circular wall with threaded outer periphery, which defines stepped circular, space therein;

a cap member fastened to said annular member of said cylinder handle, said cap member having a threaded inner periphery in registry with said threaded outer periphery of said annular member and a circular hole centrally formed on the back portion thereof;

a funnel shaped adaptor intermediately retained by said cap member into said circular space therein, said adaptor having a hollow hemispherical portion with an outer diameter slightly less than the inner diameter of said annular member, and a central tubular portion extending from the bottom and in communication with said hemispherical portion, said tubular portion having an outer diameter slightly less than said circular hole of said cap member;

said cord assembly comprising a cord connected at each end with a hoop member respectively;

whereby the two ends of said cord assembly are flexibly coupled with said two handle assemblies respectively.

* * * * *